United States Patent [19]

DiFiore

[11] 4,136,500

[45] Jan. 30, 1979

[54] BASEMENT WATERPROOFING SYSTEM

[76] Inventor: Dante DiFiore, 5387 Wilson Mills Rd., Highland Heights, Ohio 44143

[21] Appl. No.: 891,685

[22] Filed: Mar. 30, 1978

[51] Int. Cl.[2] ..... E04B 1/00; E04G 21/00

[52] U.S. Cl. ..... 52/742; 52/169.5; 52/169.14

[58] Field of Search ..... 52/169.1, 169.5, 169.14, 52/742, 514; 61/11, 13

[56] References Cited

U.S. PATENT DOCUMENTS

| | | | |
|---|---|---|---|
| 862,276 | 8/1907 | Newman | 61/13 |
| 1,433,205 | 10/1922 | Hodges | 52/169.5 |
| 3,156,490 | 11/1964 | Myll | 61/11 X |
| 3,332,185 | 7/1967 | Adams | 52/169.5 X |
| 3,426,487 | 2/1969 | Forte | 52/169.5 X |
| 3,562,982 | 2/1971 | Parezo | 52/169.5 |
| 3,754,362 | 8/1973 | Daimler | 52/169.5 |
| 3,823,825 | 7/1974 | Bergles et al. | 61/11 X |
| 3,852,925 | 12/1974 | Gazzo | 52/169.5 |
| 3,895,466 | 7/1975 | Melton | 52/169.1 X |
| 4,045,964 | 9/1977 | Barclay | 52/169.5 |

FOREIGN PATENT DOCUMENTS

| | | | |
|---|---|---|---|
| 2263896 | 7/1974 | Fed. Rep. of Germany | 52/169.5 |
| 761385 | 11/1956 | United Kingdom | 52/169.14 |

OTHER PUBLICATIONS

American Builder, Apr. 1963, pp. 60, 61, "Dry Basements - How to Build Them to Satisfy Today's Buyer".

*Primary Examiner*—Leslie Braun
*Attorney, Agent, or Firm*—David A. Burge Co.

[57] ABSTRACT

A method of overcoming the problem of water seeping into the basement of a dwelling or other structure includes procedures for treating a hollow basement wall and for treating the footer drainage tile system which extends perimetrically around the basement wall footer. Wall treatment is effected by pumping a hardenable filler material, in fluid form, into the hollow wall to fill and seal the hollow wall portions as the filler material hardens. The filler material also operates to fill and seal cracks formed in the outer surface of the wall. Drainage tile system treatment is effected by digging a plurality of holes at spaced locations around the perimeter of the basement wall to expose portions of the footer drainage tile system at these locations, by removing portions of the footer drainage tile system at the locations of the holes, by cleaning the interior of the footer drainage tile system, and by reconstructing the removed portions of the footer drainage tile system to provide each of the reconstructed portions with a clean-out branch having a near-ground-level access. Open upper ends of the clean-out branches are capped with novel removable cover structures. Lower regions of the holes are filled with porous particulate material to provide reservoirs for receiving and temporarily retaining water. If the footer drain tile are found to be laid at an unduly high level with respect to the basement floor, selected ones of these tile nearest the main drain conduit are replaced at a lower level and are surrounded by a bed of porous particulate material to provide a reservoir for receiving and temporarily retaining water. In some instances, a sump, a sump pump and/or a backflow prevention system may be added to improve operation of the footer drainage tile system.

12 Claims, 7 Drawing Figures

BASEMENT WATERPROOFING SYSTEM

BACKGROUND OF THE INVENTION

1. Field of the Invention

The present invention relates generally to a method of overcoming the problem of water seeping into the basement of a dwelling or other structure, and, more particularly, to a basement waterproofing system which includes procedures for treating hollow portions of the basement wall and for treating the footer drainage tile system which surrounds the basement wall footer.

2. Prior Art

Basement walls of many dwellings and other structures are formed from hollow tiles and/or hollow blocks laid atop a poured concrete footer. The hollow tiles and/or blocks provide hollow passages extending in planes substantially parallel to the planes of the inner and outer surfaces of the basement walls. A problem with basement wall constructions of this type is that, when water seeps through a crack in the outer surface of the wall and into these hollow passages, it oftentimes travels long distances within the wall before emerging into the basement through a crack formed in the inner wall surface. When this problem occurs, the location at which water emerges into the basement may give very little clue as to the location of the outer wall crack, and locating the outer wall crack requiring repair may be quite difficult. Moreover, efforts made to close the interior wall crack are seldom successful in preventing seepage into the basement because water which has entered the hollow passages of the wall will tend to travel for whatever distance is required to find another interior wall crack through which it may seep into the basement.

A further problem found with many existing dwelling structures is that the footer drainage tile system provided around the perimeter of the concrete footer is often clogged. Unless the problem of the clogged drain tile is treated, such efforts as may be made to repair cracks in the basement wall are oftentimes found to be of little avail. Ground water will tend to accumulate within the vicinity of the clogged tile and may rise to a level above the basement floor, causing the wall to be saturated with resulting seepage into the basement.

While methods have been developed for treating outer surfaces of basement walls to inhibit water seepage into the walls, most efforts of this sort have been found to achieve relatively unreliable results unless coordinated with efforts to assure the proper operation of the footer drainage tile system. The most accepted and most reliable approach which has been found for waterproofing basement walls of existing structures has required excavation around the entire perimeter of the basement wall to expose not only the complete outer surface of the basement wall but also the tiles of the footer drainage tile system whereby the complete outer surface of the basement wall can be waterproofed and whereby the footer drainage tile system can be cleaned out and its proper operation assured.

A problem with the described accepted system is that it is oftentimes quite expensive to carry out. Moreover, in many instances, the excavation which must be done alongside the entire perimeter of the basement wall requires the removal, replacement and/or destruction of bushes, trees and other landscape improvements. While shortcuts to this approach of complete perimetrical excavation have been proposed, in most instances these shortcuts have been found to be deficient in that, while they may provide for certain treatment of the basement wall to prevent seepage therethrough, they do not ordinarily involve any treatment of the footer drainage tile system.

SUMMARY OF THE INVENTION

The present invention overcomes the foregoing and other drawbacks of prior art proposals by providing a novel and improved system for overcoming the problem of water seeping into the basement of a dwelling or other structure, and by providing a novel and improved combination of procedures for treating basement walls and treating the footer drainage tile systems of existing structures. The present invention also provides a novel removable clean-out cover for use with bell-and-spigot tile.

A feature of the present invention resides in its inclusion of appropriate steps for treating both the problem of water traveling from point to point within a basement wall and the problem of improper operation of the footer drainage tile system. An important feature of the present invention resides in the fact that it can be carried out without requiring evcavation around the entire perimeter of a basement wall as has ordinarily been required where effective waterproofing measures are taken. A further feature of the present invention resides in its provision of a plurality of near-ground-level clean-out accesses through which the footer drainage tile system may be cleaned at future times to assure the continued proper operation of the footer drainage tile system. Still another feature resides in the provision of a novel cover for clean-out access passages.

In accordance with the preferred practice of the present invention, hollow basement wall portions are treated by forming a plurality of openings in these wall portions to provide communication with their hollow interior. Wall treatment is effected by pumping a hardenable filler material, in fluid form, through the openings into the hollow interior to fill and effect a sealing of the hollow interior as the filler material hardens. The filler material also operates to fill and seal wall cracks and is particularly effective in sealing outer wall surface cracks. After the hollow interior has been filled, the openings formed in the wall portions are closed.

Footer drainage tile system treatment is effected by digging a plurality of holes at spaced locations around the perimeter of the basement wall to expose portions of the footer drainage tile system at these locations. Portions of the footer drainage tile system at the locations of the holes are removed to provide access to the interior of the footer drainage tile system. The interior of the footer drainage tile system is cleaned and the removed portions are reconstructed. Each of the reconstructed portions is provided with a clean-out branch having near-ground-level access opening. The near-ground-level access openings are capped by removable covers. The holes are refilled with at least the lower regions of the holes being refilled with porous particulate material to provide reservoirs about the reconstructed tile system portions for receiving and temporarily retaining water.

During treatment of the drainage tile system, the location is ascertained of the juncture of this system with a drain conduit into which the system drains. A manhole with a near-ground-level access is constructed at this juncture to permit future servicing of the footer drainage tile system and of the drain conduit. The manhole may also serve as a sump into which water from the surrounding reservoir may drain. The sump may be provided with a sump pump for discharging water above ground in the event that the water level in the reservoir rises to a height approaching the level of the basement floor surface.

In some instances, when the holes are dug to provide access to the footer drainage tile system, it is found that the footer drainage tile system is installed at an unduly high level with respect to the basement floor, oftentimes quite near the level of the basement floor surface. Were this is the case, portions of the drainage tile system which lie near the juncture of this system with the drain conduit are removed and are replaced at a lower elevation surrounded by a bed of porous particulate material to provide a reservoir for receiving and temporarily retaining water. Where required, the manhole provided at the juncture of the drainage tile system and the drain conduit may serve as a sump into which water from the footer drainage tile system drains by gravity, and a sump pump may be provided for raising water from the sump into the drain conduit. In such instances, the sump pump is provided with a check valve to prevent backflow of water from the drain conduit through the pump into the sump, and is set to begin operating when water in the sump rises to a level near that of the reconstructed drainage tile system portions.

In situations where backflow from the drain conduit into the footer drainage tile system is found to be a problem, the method of the present invention is supplemented by inserting a backflow prevention valve in the drain conduit at the location of the manhole. Where a backflow prevention valve is added, portions of the drain conduit which lie downstream from the backflow prevention valve are provided with a branch passage through which backflow water from the drain conduit can discharge above ground. The branch passage serves to relieve any backflow pressure which might otherwise result in downstream portions of the drain conduit when the backflow valve has closed. The branch passage also serves as a clean-out access for the drain conduit.

As will be apparent from the foregoing summary, it is a general object of the present invention to provide a novel and improved system for overcoming the problem of water seeping into basements of the type having hollow wall portions and of the type which are provided with a footer drainage tile system.

It is a further object of the present invention to provide a novel and improved basement waterproofing system including procedures for treating both hollow basement walls and footer drainage tile systems.

These and other objects and a fuller understanding of the invention described and claimed in the present application may be had by referring to the following description and claims taken in conjunction with the accompanying drawings.

DESCRIPTION OF THE PREFERRED EMBODIMENT

Figure 1:
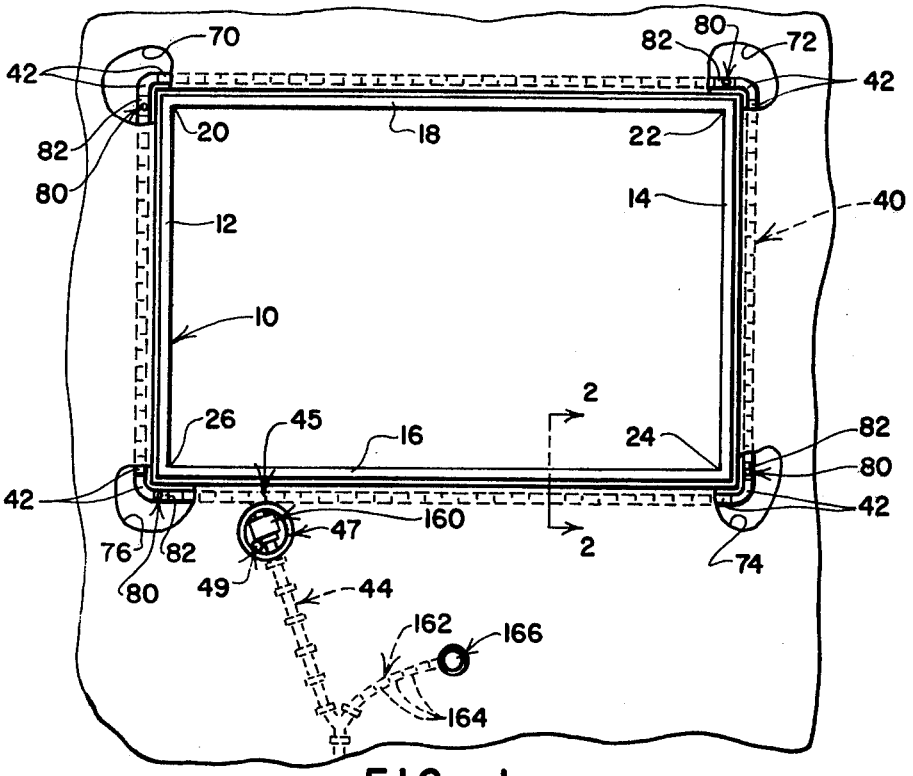
FIG. 1 is a top plan view of a basement wall of a dwelling or similar structure showing four holes dug in the ground at the four corners of the basement wall to provide access to a footer drainage tile system extending perimetrically around the footer of the basement wall.

Referring to FIG. 1, the basement foundation wall of a dwelling or other similar structure is indicated generally by the numeral 10. The foundation wall 10 includes sidewalls 12, 14 and front and back walls 16, 18. Corners 20, 22, 24, 26 are formed at the junctures of the walls 12, 14, 16, 18.

Figure 2:
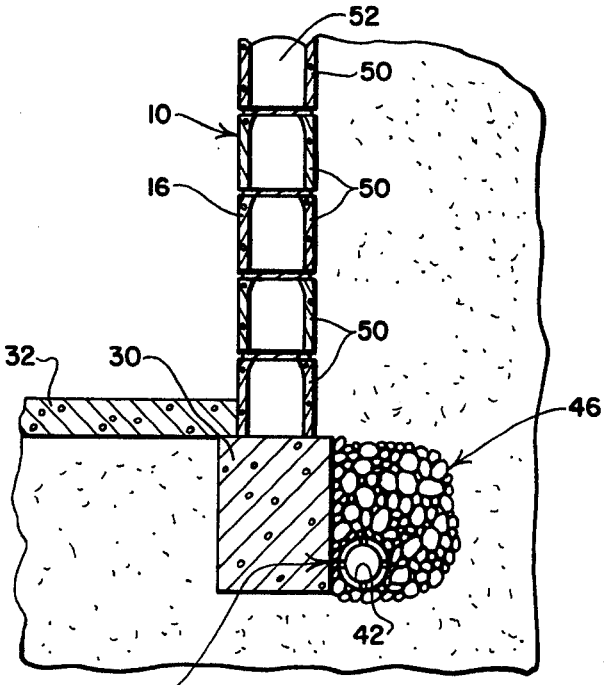
FIG. 2 is an enlarged sectional view as seen from a plane indicated by a line 2—2 in FIG. 1.

As is best seen in FIG. 2, a poured concrete footer 30 underlies the basement wall 10. A poured concrete floor 32 has portions overlying the inner sides of the footer 30 and extending into abutting engagement with the walls 12, 14, 16, 18.

Referring to FIGS. 1 and 2, a footer drainage tile system, indicated generally by the numeral 40, is provided along outer surface portions of the poured concrete footer 30. The footer drainage tile system 40 includes a plurality of conventional, elongate drain tile 42 arranged end-to-end to establish a continuous conduit extending perimetrically around outer portions of the footer 30 and being graded to drain, by gravity, into a drain conduit indicated generally by the numeral 44. As is well known to those skilled in the art, a bed of porous particulate material, typically slag, as indicated generally by the numeral 46, is provided around the tiles 42 of the drainage tile system 40 to assure that an intricate network of passages is provided adjacent the tiles 42 for channeling groundwater into the footer drainage tile system 40. Additionally, the bed of slag 46 normally provides something of a "reservoir" within which groundwater can be received and temporarily retained during a particularly intense storm when the capacity of the drainage tile system 40 may be overloaded.

Figure 3:
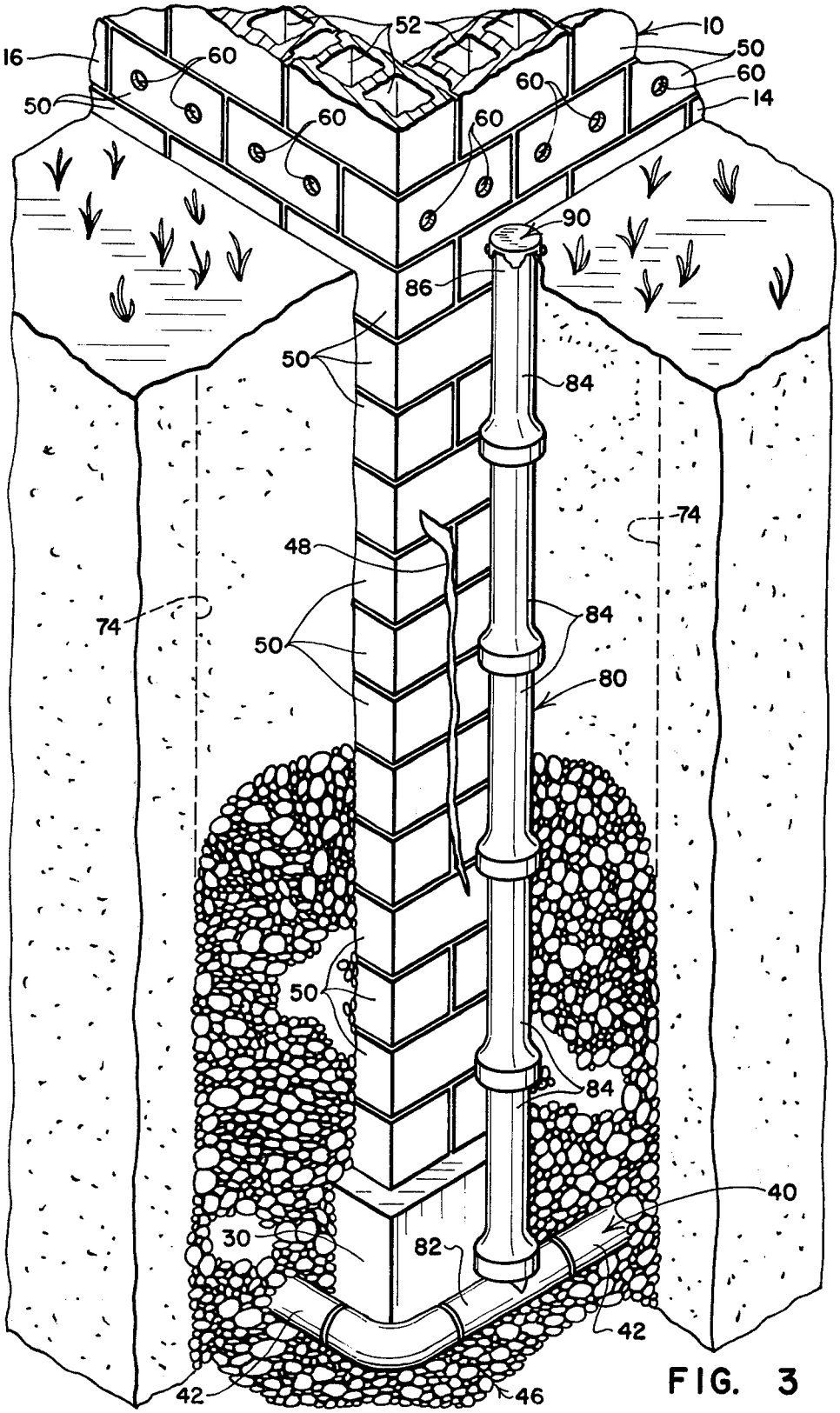
FIG. 3 is an enlarged perspective view of a portion of the basement wall with portions of the surrounding fill broken away to illustrate how footer drainage tile system portions are reconstructed and provided with a clean-out branch in accordance with the preferred practice of the present invention.
Figure 7:
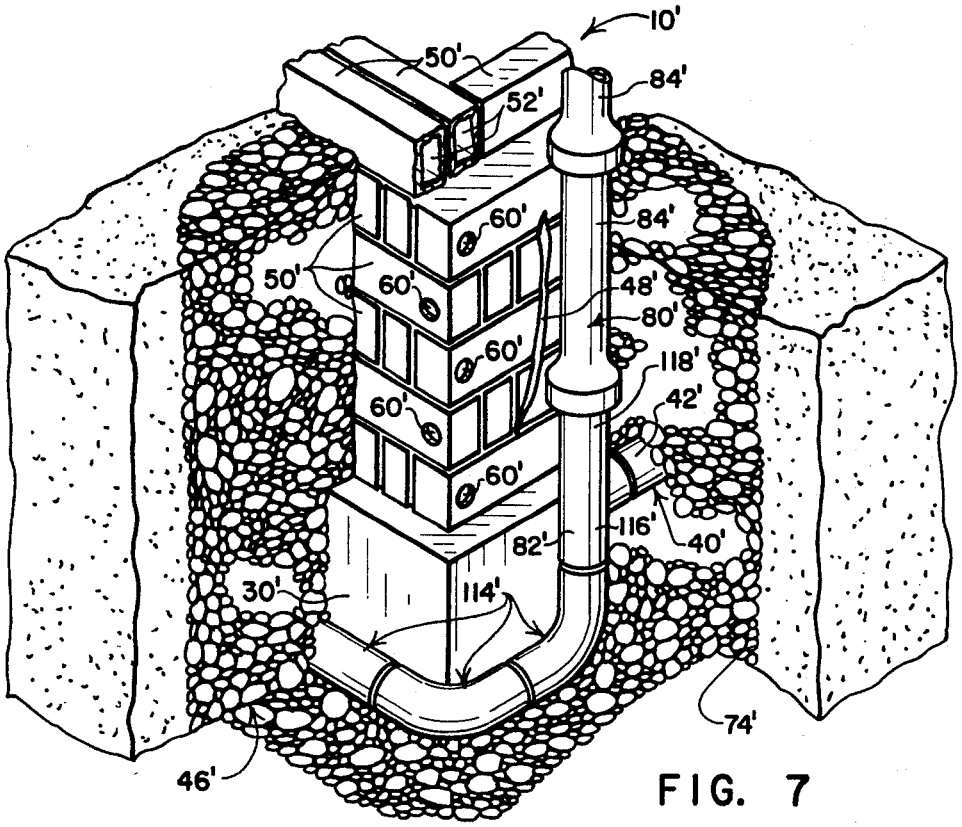

While the basement wall 10 is illustrated in FIG. 3 as being formed from conventional, hollow concrete blocks 50 secured together with mortar in the usual fashion, it will be appreciated that this wall may take the form of a wall 10' of the type shown in FIG. 7 wherein hollow tiles 50' are secured together with mortar in the usual fashion, or may take other forms utilizing such construction techniques as may provide hollow passages within the basement wall. By way of example, the basement wall 10 may be formed with a combination of hollow blocks 50 and hollow tiles 50'. In any of these events, the wall 10 is hollow and is provided with passages extending in planes substantially paralleling its planes of the inner and outer surfaces. As is ordinarily the case, such hollow passages as are formed within the wall 10 ordinarily tend to interconnect one with another, (if for no other reason than by virtue of imperfect or discontinuous mortar joints) such that the entire interior of the hollow wall 10 may well be interconnected by a common passage.

One problem with conventional dwelling constructions of the type described above is that, in the event of the formation of a crack, such as is indicated by numerals 48, 48' in FIGS. 3, 7, in the outer surface of the basement wall 10, water seeping into the hollow interior of the walls 10, 10' may travel long distances within these walls before seeping through the inner surface of the basement walls at one or more locations spaced a substantial distance from the outer wall surface cracks 48, 48'. When this happens, efforts to stop seepage by treating inner wall surface cracks is seldom effective.

Still another problem with the above-described construction is that the tiles of the footer drainage tile system 40 may tend to clog after a substantial period of use. In the event that the tiles of the system 40 clog and cease to function, groundwater may tend to collect in the vicinity of the tiles of the system 40 and may build up to a level above the top of the basement floor 32, whereupon the basement wall 10 may become saturated, resulting in seepage of water into the basement.

In accordance with the preferred practice of the present invention, a plurality of holes 60, best seen in FIG. 3, are formed through the outer and/or inner surfaces of the basement wall 10 to provide communication with passages formed inside the wall 10. Where the wall 10 is formed from concrete blocks 50 and accordingly is provided with a plurality of vertically extending passages 52, the holes 60 are drilled in a horizontally extending array at spaced locations around the perimeter of the wall 10 to provide communication with each of the passages 52. The holes 60 are preferably drilled above ground level. In the event the hollow wall portion does not extend above ground level, the holes 60 are preferably drilled in the uppermost course of blocks 50. Where, as is shown in FIG. 7, the wall 10' is formed from tiles 50' and has horizontally extending passages 52' formed therein, holes 60' are drilled in one or more vertically extending arrays to provide communication with each of the passages 52'. In either event, the holes 60, 60' are preferably of about two inches in diameter and are arranged to provide thorough communication with the hollow interior of the walls 10, 10'. While the holes 60, 60' are shown in FIGS. 3 and 7 as being formed through the outer surfaces of the walls 10, 10', it will be understood that these holes may also be formed through interior surfaces of the walls 10, 10', and that some of the holes 60, 60' may be formed through inner wall surfaces while others may be formed through outer wall surfaces of the walls 10, 10'.

Once the holes 60, 60' are drilled, a hardenable filler material is pumped, in fluid form, through the openings 60, 60' into the wall passages 52, 52' to fill and effect a sealing of the wall passages 52, 52' as the filler material hardens. Once the hollow wall passages 52, 52' have been filled, the holes 60, 60' are closed, ordinarily by means of mortar. Once the filler material has hardened and has effectively sealed the hollow wall passages 52, 52', the possibility of seepage water traveling any substantial distance within the basement walls 10, 10' is minimized. Accordingly, if water seepage should be detected at an inner wall location, it will ordinarily be found that the outer wall crack through which the water is seeping is located quite close to the inner wall seepage location and any needed repairs can be readily effected. In many instances, the filler material itself will effect the needed sealing of outer wall cracks.

The filler material which is pumped through the holes 60, 60' may comprise any of a number of known hardenable substances such as a runny mixture of concrete, or a runny mixture of concrete with ironite added, or lighter weight substances such as plastics materials of various types of plastisols. Materials selected for this use should be capable of introduction in a substantially fluid state and capable of hardening in situ thereafter. The filler material selected must, of course, be resistant to deterioration in the presence of moisture and must be capable of adhering to the hollow interiors of walls and of filling and sealing hollow wall passages and wall cracks. In some instances, it may be desirable to fill lower ones of the passages 52' or lower portions of the passages 52 with a denser, highly water-impervious composition, and higher ones of the passages 52' or higher portions of the passages 52 with a less dense, less expensive filler composition, by which arrangement the most effective filler is utilized where it is most needed.

In accordance with other features of the preferred practice of the present invention, a plurality of holes are dug in the ground around the basement wall 10, preferably at least within the vicinity of the corners 20, 22, 24, 26. These holes are indicated in FIG. 1 by the numerals 70, 72, 74, 76. The holes 70, 72, 74, 76 are dug to a depth which provides access to the tiles 42 of the footer drainage tile system 40. Once the tiles 42 have been exposed at the locations of the holes 70, 72, 74, 76, selected ones of the tiles 42 are removed to provide access to the interior of the footer drainage tile system 40. A thorough cleaning of the interior of the footer drainage tile system 40 is then carried out, utilizing, where needed, a conventional electrically driven mechanical snake and/or by flushing the system with pressurized water. Other conventional cleaning techniques may also be used.

Once the footer drainage tile system 40 has been cleaned and its branches are found to be working properly, removed portions of the system 40 are reconstructed and are provided with clean-out branches, one of which is indicated generally by the numeral 80 in FIG. 3. The clean-out branch 80 includes a tee-tile 82 inserted in the footer drainage tile system 40. The clean-out branch 80 also includes a series of interconnected conventional bell-and-spigot tile 84 extending upwardly from the tee-tile 82 to a location where an end 86 of the clean-out branch 80 is located near ground level, preferably aboveground. A removable cover 90 caps the open upper end 86.

The clean-out branches 80 provide a means by which the footer drainage tile system 40 can be cleaned out and its proper operation ascertained at a future time. Inasmuch as the footer drainage tile system 40 is subject to clogging after extensive periods of use, and, inasmuch as a clogged footer drainage tile system can result in water seepage into a basement in the event that groundwater builds up around the footer drainage tile system to a level above that of the surface of the basement floor 32, it is important that the footer drainage tile system be rendered accessible for cleaning and servicing at future times. The removable covers 90 permit direct access to the footer drainage tile system 40 for these purposes.

The holes 70, 72, 74, 76 are refilled with at least their lower portions being filled with porous, particulate material such as No. 4 slag, whereby reservoirs are provided at the locations of the holes 70, 72, 74, 76 for receiving and temporarily retaining water when the footer drainage tile system 40 is operating at capacity. The slag fill in the holes 70, 72, 74, 76 preferably extends to within about twenty-four to thirty-six inches of ground level, whereby the slag in the holes 70, 72, 74, 76 serves the further function of providing routes for directing groundwater expeditiously into the footer drain tile system 40.

Figure 4:
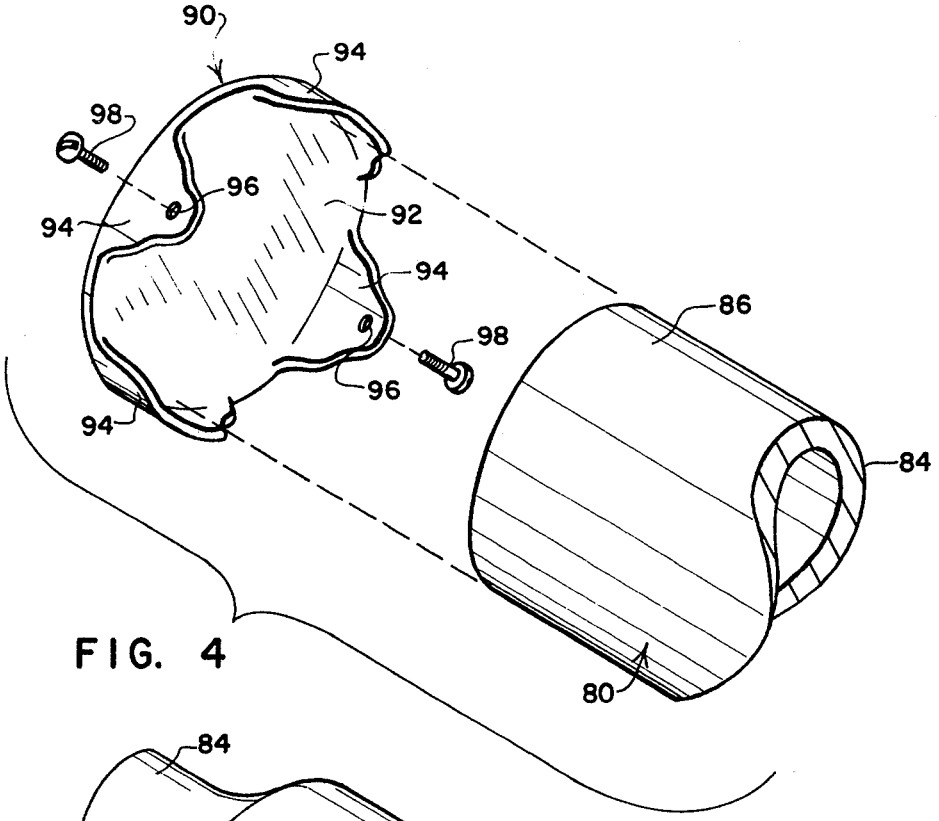
FIG. 4 is an enlarged exploded perspective view showing a clean-out end cover and the upper end of the clean-out branch of FIG. 3.

Referring to FIG. 4, the cover 90 has a disc-like base wall 92 with four arcuately curved side wall members 94 configured to surround outer portions of the upper end region 86 of the clean-out branch 80. The arcuately curved members 94 are formed integrally with the base wall 92, preferably as an aluminum alloy casting. Threaded holes 96 are formed through two of the curved members 94 and threaded fasteners 98 are provided for threading into the holes 96 and into clamping engagement with the outer surface of the annular wall which forms the upper end 86. By this arrangement, the cover 90 may be releasably secured in place on the upper end 86 by simply tightening the fasteners 98 relatively snugly into engagement with the outer wall of the upper end 86.

Figure 5:
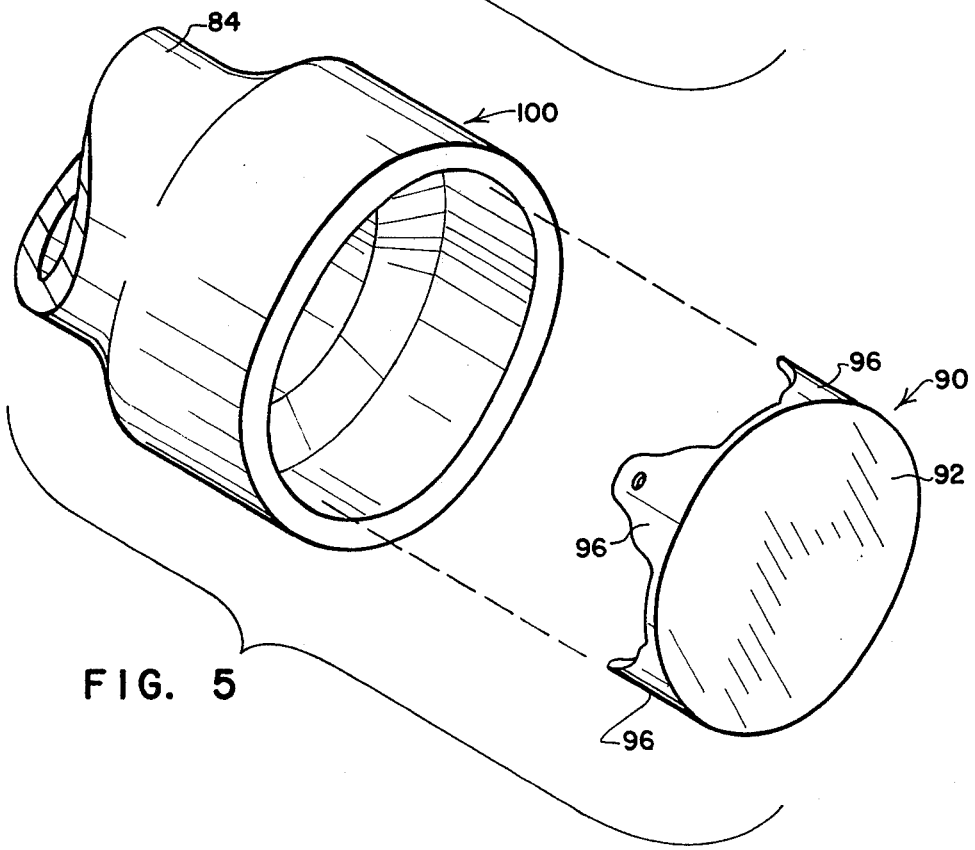
FIG. 5 is an exploded perspective view similar to FIG. 4 showing an alternate use of the end cover of FIG. 4.

Referring to FIG. 5, in the event that the bell-and-spigot tiles 84 are arranged with their bell-ends upwardly, rather than downwardly as shown in FIG. 3, a bell formation 100 will form the open upper end of the clean-out passage 80. In order to serve this situation, the cover 90 is adapted to be slip-fitted into the inside of the bell 100 and may be removably secured therein by means of a suitable sealant and/or adhesive material, one example being mortar.

During treatment of the footer drainage tile system 40, the location is ascertained where the tiles 42 of the system 40 connect with and discharge into a drain conduit 44. Such a location is indicated in FIG. 1 by the numeral 45. Once the location 45 is ascertained, a manhole 47 of approximately 36" in diameter is constructed at or near this location using conventional precast concrete wall members. The manhole 47 is provided with a near-ground-level access opening closed with a conventional manhole cover, not shown.

The manhole 47 may serve several purposes. It may serve as a sump into which water from the reservoir 46 drains. In such event, and in the event it is needed, the manhole 47 may be provided with a sump pump 49 for discharging water above ground when the water level in the manhole rises to a level approaching that of the basement floor 32. The manhole may serve as the location of a juncture between the drain conduit and one or more branch conduits serving downspouts of the dwelling or other structure. The manhole may also serve as the location for a backflow prevention valve 160, as will be discussed below. The manhole 47 may also provide a means by which access, without excavation, may be had at future times to the juncture of the footer drainage tile system 40 and the drain conduit 44 for purposes of service.

Figure 6:
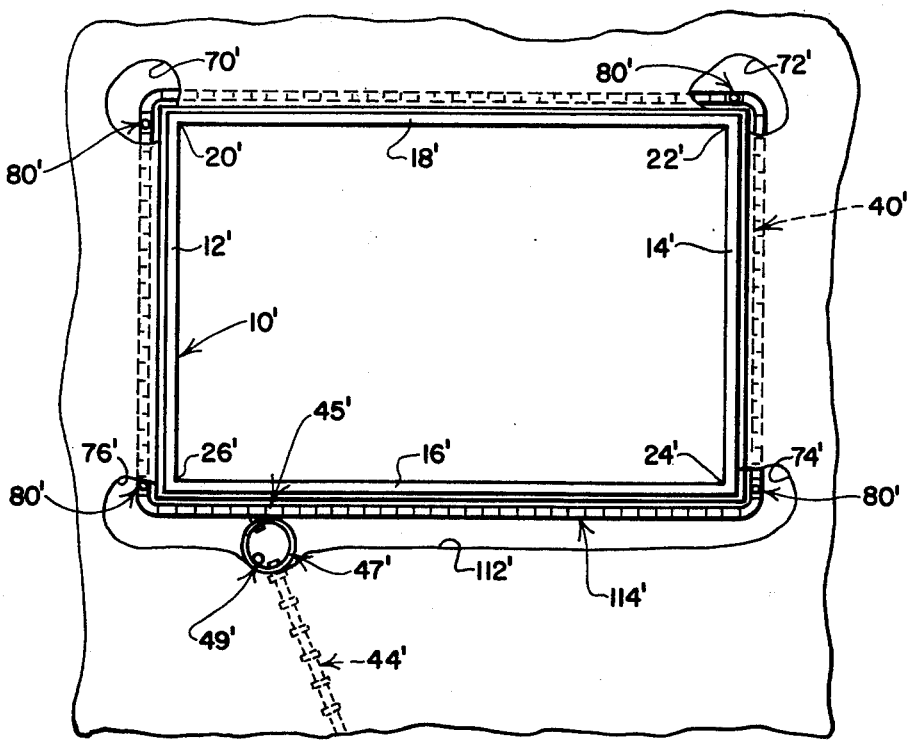
FIG. 6 is a top plan view similar to FIG. 1 showing an alternate practice of the present invention; and, FIG. 7 is an enlarged perspective of a portion of the basement wall of FIG. 6 with portions of the surrounding fill broken away to illustrate details of the present invention.

Referring to FIGS. 6 and 7, an alternate practice of the present invention is illustrated with such elements of the drawings as correspond to the elements of FIGS. 1–3 being indicated by the same numerals utilized in FIGS. 1–3 but with these numerals carrying a prime mark. The practice illustrated in FIGS. 6 and 7 is utilized when, upon digging the holes 70, 72, 74, 76, it is found that the tiles 42' of the footer drainage tile system 40' are located at an unduly high level with respect to the basement floor, oftentimes quite near the level of the basement floor surface. The tile indicated by the numeral 42' in FIG. 7 is at such an unacceptably high level. Those skilled in the art will understand that the level of the tile 42' is unacceptably high because, in the event the system 40' is operating at capacity as during a heavy rainstorm, any water which builds up around the tile 42' will quickly rise to a level above the surface of the basement floor and may cause seepage into the basement.

Where the tiles of the footer drainage tile system 40' are found to lie at this unacceptably high level, the location of the juncture 45' of the footer drainage tile system 40' with a drain conduit 44' is ascertained, and an excavation is made along basement wall portions near the juncture 45'. Such tiles 42' of the footer drainage tile system 40' as are exposed by this excavation are removed. In FIG. 6, this additional excavation is indicated by the numeral 112' and is shown as extending the entire distance along the front wall 16' between and joining the holes 74', 76'. Once tiles 42' of the footer drainage tile system which lie within the region of the excavation 112' are removed, the excavation 112' is continued to a level suitably below the level of the basement floor. In preferred practice, the excavation 112' is continued to a level at least eight to twelve inches below the surface of the basement floor. Once this excavation has been completed, and once the previously described clean-out of the branches of the drainage tile system 40' has been completed, removed portions of the footer drainage tile system 40' are reconstructed to lie at the base of the excavation 112', i.e., at a lower level with respect to the basement floor.

Referring to FIG. 7, reconstructed portions of the footer drainage tile system 40' are indicated by the numeral 114'. The reconstructed portions 114' preferably include a tee-tile 82' which communicates with the tile 42' and which provides a downwardly directed leg 116' for communication with the reconstructed tile portions 114'. The tee-tile 82' also provides an upwardly directed leg 118' for communication with a clean-out branch 80' formed by a series of newly installed bell-and-spigot tile 84'.

By lowering the level of the reconstructed tile portions 114' to a distance substantially below the surface of the basement floor, in the event that the footer drainage tile system 40' becomes overloaded during a particularly heavy rainstorm, the level of water buildup adjacent the footer 30' will begin at a substantially lower level that it would otherwise and will likely not rise above the level of the surface of the basement floor. A bed of porous particulate material 46' is provided in lower portions of the excavation 112' about the reconstructed tile portions 114' to provide an area within which water may be received and temporarily retained when the footer drainage tile system 40' is operating at capacity.

As will be appreciated by those skilled in the art, when portions of the footer drainage tile system 40' are reconstructed, as described, to position them at a lower level, it may be necessary to rebuild a portion of the drain conduit 44' into which the reconstructed portions 114' of the footer drainage tile system 40' drains. Since portions of the drain conduit 44' which connect with the footer drainage tile system 40' will probably have been originally installed to lie at substantially the same level as the area of juncture 45', when this juncture location is lowered, connecting portions of the drain conduit 44' will need to be reconstructed so that water can drain, by gravity, into the drain conduit 44'.

In the event that the drain conduit 44' is found to lie at a sufficiently low level as to require no reconstruction, or in the event that a portion of the drain conduit 44' can be reconstructed with ease to allow gravity drainage thereinto from the footer drainage tile system 40', it may nonetheless be desirable to provide the manhole 47' with a sump pump 49' set to begin pumping water to an aboveground discharge location (not shown) in the event that the level of water within the manhole 47' rises to a level approaching that of the basement floor. If it is found that much of the drain conduit 44' is laid at too high a level to receive a gravity flow of water from the footer drainage tile system 40', the manhole 47' is utilized as a sump, into which water from the footer drainage tile system 40' drains. A sump pump 122' is provided within the manhole 45' for raising water from the manhole sump and pumping it through a check valve (not shown) into downstream portions of the drain conduit 44'. In this situation, the sump pump 122' is set to begin pumping when water in the manhole sump rises to near the level of the reconstructed tile portions 114'. In this situation, the sump pump 122' is provided with an alternate aboveground discharge outlet (not shown) through which water from the sump may be discharged when the check valve is closed due to back pressure in the drain conduit.

Referring again to FIG. 1, if it is found that water backflowing through the drain conduit 44 and into the footer drainage tile system 40 constitutes a problem, it is preferred to extend the procedure of the present invention to include the installation of a backflow prevention system within the drain conduit 44. Steps involved in installing such a backflow prevention system include the installation of a conventional backflow prevention valve, indicated generally by the numeral 160, in the drain conduit 44 at the location of the manhole 45. Additionally a branch conduit, indicated generally by the numeral 162, is added to the drain conduit 44, at a location downstream from the backflow prevention valve 160. The branch conduit 162 includes a series of tile 164 which communicate downstream portions of the drain conduit with a ground-level opening 166. By this arrangement, in the event that water backs up in the drain conduit 44, the backflow prevention valve 160 will close and any backflow pressure which results in downstream portions of the drain conduit 44 will be relieved by the branch conduit 162 through the ground-level opening 166. The branch conduit 162 also provides an access for future use in cleaning out the drain conduit 44.

As those skilled in the art will appreciate, the drain conduit 44 may include one or more Y-connections (not shown) communicating with other branch conduits leading to downspout connections. The backflow prevention valve 160 must be installed in the drain conduit 44 upstream from these Y-connections so that water from the downspouts does not back up into the footer drainage tile system 40. Moreover, the level of the ground-level opening 166 should be beneath that of the aboveground ends of the downspout branch conduits so that any water backing up in the drain conduit 44 will discharge through the opening 166 rather than through the upper ends of the downspout branch conduits.

Backflow prevention valves, also known in the art as "backwater traps", are available commercially from a number of sources, one being Jumbo Manufacturing Company, Cleveland, Ohio 44103 and another being Jones Manufacturing Company, Birmingham, Ala. 35210.

A further procedure which may be followed in accordance with the preferred practice of the present invention and which has not been illustrated in the drawings, is the rerouting of a portion of the footer drainage tile system 40 in the event that the footer drainage tile system 40 is found to extend under such constructions as steps or chimneys. It has been found where footer drainage tile extend under such structures as steps and chimneys, the footer drainage tile system 40 does not function as well as it should and such portions of the footer drainage tile system as extend near such structures should be provided with a branch which extends around the perimeter of these structures.

As will be apparent from the foregoing description, the present invention provides a system which treats both the problem of water traveling through hollow passages within a basement wall and the problem of an improperly operating footer drainage tile system. The procedures required to carry out the system of the present invention are relatively simple and inexpensive to effect, particularly in comparison with previously proposed approaches that have required full perimetrical excavation around the outer surface of a basement wall. The system of the present invention ordinarily necessitates the removal, replacement and/or destruction of relatively few bushes, trees and other landscape improvements. Moreover, once the system of the present invention has been utilized, in the event that further seepage problems are detected, the exact area of the outer wall surface which requires treatment can ordinarily be ascertained with relative ease and the proper operation of the footer drainage tile system can be checked and the system cleaned out without requiring further excavation.

While it is not represented that the system of the present invention will permanently, completely, perpetually, seal and prevent the entry of water into basements of dwellings through foundation walls, it is submitted that the system of the present invention provides a reasonable approach to obtaining waterproofing protection and at a substantially lower expense than obtains where excavation must be conducted along the entire perimeter of a foundation wall. While it is not represented that the system of the present invention will find successful application in all types of basement walls, floors and foundations, it is submitted that, in many instances where basement walls are formed with hollow passages and wherein footer drainage tile systems may have become at least partially clogged, the system of the present invention will be effective to greatly reduce if not eliminate the problem of groundwater seeping into basements.

Although the invention has been described in its preferred form with a certain degree of particularity, it is understood that the present disclosure of the preferred form has been made only by way of example and numerous changes in the details of procedure and construction and the combination and arrangement of steps and parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A method of overcoming the problem of water seeping into the basement of a dwelling or other structure of the type having a basement wall supported atop a poured concrete footer, at least portions of the basement wall being hollow, and of the type having a footer drainage tile system extending around the perimeter of the footer, the method comprising the steps of:

(a) treating the basement wall portions by:

(i) forming a plurality of openings in the basement wall portions to provide communciation with the hollow interior of the basement wall portions;

(ii) pumping a hardenable filler material in fluid form through the openings into the hollow interior to fill and to effect a sealing of the hollow interior as the filler material hardens; and, (iii) after the hollow interior has been filled, closing the openings formed in the basement wall portions; and, (b) treating the footer drainage tile system by:

(i) digging a plurality of holes at spaced locations around the perimeter of the basement wall to expose the footer drainage tile system at these locations;

(ii) removing portions of the footer drainage tile system at the locations of the holes;

(iii) cleaning the interior of the footer drainage tile system to assure its proper operation;

(iv) reconstructing the removed portions of the footer drainage tile system and providing each of the reconstructed portions of the system with a clean-out branch extending upwardly through the region of its associated hole to provide an open upper end near ground level, whereby a plurality of near-ground-level accesses communicating with the footer drainage tile system are provided;

(v) capping the open upper ends of the clean-out branches with removable cover structures; and, (vi) refilling the holes with at least lower regions of the holes being filled with porous particulate material to provide reservoirs surrounding the reconstructed portions of the footer drainage tile system for receiving and temporarily retaining water.

2. The method of claim 1 wherein the basement wall has a substantially rectangular perimetrical configuration and the holes include at least four holes, each being dug in the vicinity of a separate one of the four corners of the basement wall.

3. The method of claim 1 wherein the hollow basement wall portions are formed from blocks having vertically extending hollow passages formed therethrough, and the step of forming a plurality of openings through the wall to provide communication with hollow passages is effected by forming at least one horizontally extending array of openings through the wall portions.

4. The method of claim 3 wherein the openings are formed through the outer surface of the basement wall portions.

5. The method of claim 3 wherein the array of openings is formed through the inner surface of the basement wall portions.

6. The method of claim 1 wherein the hollow portions of the basement wall are formed from tile having horizontally extending passages formed therethrough, and the step of forming openings through the wall to provide communication with hollow passages is effected by forming at least one vertically extending array of openings through the wall portions.

7. The method of claim 6 wherein the openings are formed through the outer surface of the basement wall portions.

8. The method of claim 6 wherein the openings are formed through the inner surface of the basement wall portions.

9. The method of claim 1 wherein the footer drainage tile system communicates at a juncture location with a drain conduit, and the step of treating the footer drainage tile system includes the step of lowering the elevation of portions of the footer drainage tile system in the vicinity of the juncture location and restructuring at least a portion of the drain conduit so that water from lowered portions of the footer drainage tile system can drain, by gravity, directly into the restructured drain conduit portion.

10. The method of claim 9 wherein the step of lowering the elevation of portions of the footer drainage tile system includes the step of surrounding the lowered portions of the drainage tile system with a bed of porous particulate material to provide a reservoir about the lowered portions of the footer drainage tile system for receiving and temporarily retaining water.

11. The method of claim 9 wherein the step of restructuring the drain conduit portion includes the step of providing a sump in the drain conduit downstream from the juncture location whereby water from the footer drainage tile system will flow by gravity into the sump, and providing a sump pump in the sump for raising water from the sump into the drain conduit.

12. The method of claim 1 wherein the footer drainage tile system communicates at a juncture location with a drain conduit and is configured to drain water by gravity from the footer drainage tile system into the drain conduit, and wherein the method includes the further steps of:

(a) inserting a backflow prevention valve in the drain conduit downstream from the juncture location to prevent water backing up through the drain conduit into the footer drainage tile system; and, (b) adding a branch to the drain conduit downstream from the backflow prevention valve, the added branch communicating portions of the drain conduit which are downstream from the backflow prevention valve with the ground surface to provide a passage through which backflow water from the drain conduit can discharge above ground when the backflow prevention valve is closed, whereby backflow pressure in downstream portions of the drain conduit may be relieved.

* * * * *